US011459785B2

(12) United States Patent
Simmons

(10) Patent No.: US 11,459,785 B2
(45) Date of Patent: Oct. 4, 2022

(54) POST SOCKET

(71) Applicant: Martin Simmons, Ashton (GB)

(72) Inventor: Martin Simmons, Ashton (GB)

( * ) Notice: Subject to any disclaimer, the term of this patent is extended or adjusted under 35 U.S.C. 154(b) by 367 days.

(21) Appl. No.: 16/714,353

(22) Filed: Dec. 13, 2019

(65) Prior Publication Data

US 2020/0190843 A1 Jun. 18, 2020

(30) Foreign Application Priority Data

Dec. 17, 2018 (GB) ..... 1820510

(51) Int. Cl.
*E04H 12/22* (2006.01)

(52) U.S. Cl.
CPC ..... *E04H 12/2269* (2013.01)

(58) Field of Classification Search
CPC ..... E04H 12/2269; E04H 12/2261; E04H 12/2276; F16B 2/14
See application file for complete search history.

(56) References Cited

U.S. PATENT DOCUMENTS 1,388,268 A * 8/1921 Knutson ..... F16B 2/14 52/700
3,163,908 A * 1/1965 Lawmaster ..... B28B 7/0094 249/DIG. 4
4,059,934 A * 11/1977 Hayamizu ..... A63B 71/028 52/297
4,111,575 A * 9/1978 Hoshino ..... F16B 7/1418 403/373
4,140,415 A * 2/1979 Koyamato ..... G10G 5/00 403/104
4,430,017 A * 2/1984 Stefancich ..... F16M 11/245 403/109.5
4,497,092 A * 2/1985 Hoshino ..... F16B 7/1418 24/514

(Continued)

FOREIGN PATENT DOCUMENTS

CA 2289059 A1 * 11/1998 ..... E01F 9/617
DE 225200 C 9/1909

(Continued)

OTHER PUBLICATIONS

UK Intellectual Property Office Search Report dated May 29, 2019 for UK Patent Application No. GB 1820510.4.

*Primary Examiner* — Brian D Mattei
*Assistant Examiner* — Charissa Ahmad
(74) *Attorney, Agent, or Firm* — Reichel Stohry Dean LLP; Mark C. Reichel; Natalie J. Dean

(57) ABSTRACT

A post socket includes a housing, a compressible sleeve within the housing, the sleeve being moveable between a first position in which the sleeve has a first internal width and a second position in which the sleeve has a second internal width, a linkage pivotably connected to the sleeve, and an actuator for actuating the linkage to move the sleeve from the first position to the second position to grip a post therein, the linkage including a linkage body connected to the actuator, the linkage further including at least one arm including a first end and a second end, the actuator being configured so that its actuation moves the linkage body to thereby move the first end and the second end of the at least one arm and thus move the sleeve from the first position to the second position.

14 Claims, 4 Drawing Sheets

(56) References Cited

U.S. PATENT DOCUMENTS

| | | | | | |
|---|---|---|---|---|---|
| 4,576,501 | A * | 3/1986 | McConnell | F16B 7/1472 | 403/104 |
| 4,744,690 | A * | 5/1988 | Hsieh | F16M 11/28 | 403/104 |
| 4,826,152 | A * | 5/1989 | Lo | A63B 22/0012 | 482/114 |
| 6,155,743 | A * | 12/2000 | Chen | F16B 7/1418 | 403/374.1 |
| 6,312,184 | B1 * | 11/2001 | Hoshino | F16B 7/1418 | 403/373 |
| 8,608,118 | B2 * | 12/2013 | Lai | F16B 7/1454 | 403/374.5 |
| 9,109,616 | B1 * | 8/2015 | Ballentine | F16B 7/1454 | |
| 2013/0175422 | A1 | 7/2013 | Clarke et al. | | |
| 2016/0312489 | A1 * | 10/2016 | Leary | E04H 12/2269 | |

FOREIGN PATENT DOCUMENTS

| | | | | |
|---|---|---|---|---|
| DE | 2133278 | A1 | 1/1973 | |
| DE | 202006007485 | U1 * | 8/2006 | A47B 91/00 |
| EP | 0208095 | B1 * | 3/1990 | E01F 9/617 |
| EP | 2110478 | A2 | 10/2009 | |
| GB | 2254349 | A | 10/1992 | |
| GB | 2482889 | A | 2/2012 | |
| GB | 2522121 | A | 7/2015 | |
| GB | 2535312 | A | 8/2016 | |
| IE | 65270 | B1 | 10/1995 | |

* cited by examiner

POST SOCKET

CROSS-REFERENCE TO RELATED APPLICATIONS

The present application claims priority under 35 U.S.C. § 119 to United Kingdom patent application GB 1820510.4 filed on Dec. 17, 2018 in the United Kingdom Intellectual Property Office, the entire disclosure of which is incorporated herein by reference.

BACKGROUND

1. Field

Aspects of the present invention relate generally to a method of releasably securing a post in the ground and in particular to a post socket that is able to releasably secure a post therein.

2. Description of the Related Art

It is necessary for signs and other traffic information to be positioned close to a road to provide the information contained on the sign to the driver of a vehicle travelling on the road. If there is not a structure already suitably positioned to receive the sign thereon, a post must be erected. Also, bollards are conventionally used to protect buildings and pedestrianised areas from motor vehicles. These bollards are typically erected in a similar manner as a post for receiving a sign. Traditionally, a hole is excavated, an end of the post is positioned within the hole, and the hole is then back filled with material such as concrete to retain the post within the hole. However, if the post becomes damaged, such as if a vehicle crashes into the post, the post must be replaced. To replace a post installed in the traditional manner explained above, the post must be freed from the ground by releasing it from, or excavating, the back-filled material. This is generally time consuming which causes delay to the traffic and an increase in labour cost.

A post socket may be used to reduce the disruption and cost of replacing a damaged post. A post socket is a mechanical device that is buried in the ground such that the post socket is typically below or flush with the surface of the ground. Post sockets are known to have a socket into which a post may be positioned. Conventional post sockets include at least one bolt which is coupled to the post socket and is driven into the side of the post to secure the post within the post socket. This means that, when the post is damaged, the post must be removed by releasing the bolt(s). A new post can then be retained within the post socket as described above.

Generally, a relatively great force is required to retain the post within the post socket. By driving a bolt into the post, this force is applied to the post by the end of the bolt(s). As the end of the bolt(s) has a small area, a substantial pressure is applied to the post. This will usually permanently deform the post by causing an indentation where the bolt contacts the post. A post for use close to a road will usually be manufactured to have specific bending and buckling characteristics, such that it performs a certain way when impacted by a vehicle. A deformed post will have different bending and buckling characteristics than was initially intended. This means that, when impacted by a vehicle, the post may not bend and buckle as required, which may cause more significant injury to the occupants of the vehicle.

Alternatively, the deformed post may not be able to perform its function and fail, for example in high winds.

Accordingly, there is a desire for an improved post socket.

SUMMARY

In a first aspect, the invention provides a post socket comprising a housing, a compressible sleeve (also referred to as a "sleeve") within the housing, the sleeve arranged to receive at least a portion of a post therein, wherein the sleeve is moveable between a first position in which the sleeve has a first internal width and a second position in which the sleeve has a second internal width which is less than the first internal width, a linkage pivotably connected to the sleeve, and an actuator for actuating the linkage to move the sleeve from the first position to the second position to grip and thus retain at least a portion of a post therein, wherein the linkage comprises a linkage body connected to the actuator, the linkage further comprising at least one arm including a first end and a second end, wherein the first end of the at least one arm is pivotably attached to the linkage body and the second end of the at least one arm is pivotably attached to the sleeve, the actuator arranged so that actuation of the actuator moves the linkage body to thereby move the first end and the second end of the at least one arm and thus move the sleeve from the first position to the second position.

The sleeve may be in the form of a cylindrical wall which may be squeezed to tighten around a post. In this way, a post may be releasably retained in a socket without being dented. Also, when compared to a conventional post socket as previously described, a relatively larger surface area of the post is gripped by the socket, which reduces the pressure applied by the socket to the post.

The post socket may be arranged to releasably retain a bollard therein. The bollard may be an anti-ram raid bollard. The bollard may be a PAS 68 type bollard.

The first and/or second internal width may be a diameter.

The sleeve may include a slot. The slot may extend at least partially along the sleeve parallel to a longitudinal axis of the sleeve. The slot may be arranged to at least partially close when the sleeve is moved from the first position to the second position by the linkage. When the sleeve is in the second position, the slot may be between 1 mm and 15 mm wide, between 2 mm and 10 mm wide, or between 3 mm and 8 mm wide. In one arrangement, the width of the slot, when the sleeve is in the second position, is 5 mm wide. Alternatively, the slot may be arranged to fully close when the sleeve is moved from the first position to the second position by the linkage. In one possibility, a first portion of the sleeve may at least partially overlap a second portion of the sleeve. In this way, the sleeve may be positioned in the first position to allow a post to be inserted into the post socket. The sleeve may then be moved to the second position, so that the slot at least partially closes, such that the sleeve grips and retains the post in the post socket. The sleeve may be moved from the second position to the first position to release a post from the post socket.

A first portion of the sleeve may be configured to at least partially overlap a second portion of the sleeve in response to actuation of the actuator. The first portion of the sleeve may be arranged to further overlap the second portion of the sleeve when the sleeve is moved from the first position to the second position by the linkage.

The sleeve may further comprise a first bracket. The first bracket may be positioned adjacent to a first side of the slot. The sleeve may further comprise a second bracket. The second bracket may be positioned adjacent to a second side of the slot. In this way, the free ends of the sleeve positioned either side of the slot may be reinforced such that distortion of the free ends is reduced and/or eliminated.

The first bracket may include a first linkage attachment point. The second bracket may include a second linkage attachment point. The first linkage attachment point and second linkage attachment point may be connected to the linkage. In this way, the linkage is able to act upon the free ends of the sleeve to accurately position the free ends of the sleeve and therefore accurately change the width of the slot.

The first linkage attachment point may include a first pin projecting therefrom. The second linkage attachment point may include a second pin projecting therefrom. In this way, the linkage may attach to the pins of the linkage attachment points.

The sleeve may further comprise a housing engagement bracket. The housing engagement bracket may be positioned on an outer surface of the sleeve. The housing engagement bracket may include a housing engagement surface. The housing engagement surface may be arranged to engage with an internal surface of the housing. The housing bracket may be attached to the housing by any means. In this way, the sleeve may be unable to move laterally within the housing, to ensure the sleeve is properly positioned within the housing.

The sleeve may be arranged to grip at least a portion of a post positioned therein around more than 75% of the post's outer perimeter. In this way, the pressure applied to the post by the sleeve may be minimised to minimise any damage caused to the post by the sleeve.

The sleeve may include a lip at its upper and/or lower end. The lip may extend from the upper and/or lower rim of the sleeve. The lip may extend from the sleeve along the upper and/or lower rim of the sleeve from a first side of the slot to a second side of the slot. The lip may be a portion of the sleeve that is angled relative to the rectilinear wall of the sleeve. The lip may be angled such that it extends away from the wall of the sleeve. The lip may be substantially planar. The angle between the lip and the sleeve may be the angle between the axis of the bore of the sleeve and a lip axis, wherein the lip axis intersects the axis of the bore of the sleeve and is parallel to a surface of the lip. The angle between the lip and the sleeve may lie in the range of 10 to 80 degrees. The angle between the lip and the sleeve may lie in the range of 20 to 70 degrees. The angle between the lip and the sleeve may lie in the range of 30 to 60 degrees. The angle between the lip and the sleeve may lie in the range of 40 to 50 degrees. The angle between the lip and the sleeve may be 45 degrees. In this way, the lip(s) may act to strengthen and/or stiffen the sleeve. A lip positioned on the upper end of the sleeve may act as a guide to allow easier installation of a pole within the sleeve.

The housing may comprise an upper surface including an actuator aperture. The actuator aperture may be for receiving a tool for rotation of the actuator therethrough, in use. An engageable portion of the actuator may be positioned within the housing and accessed through the actuator aperture. In this way, the upper surface may be positioned flush with the ground into which the post socket is installed, such that no part of the post socket protrudes above the surface of the ground. The upper surface may include a post aperture for receiving at least a portion of a post therethrough, in use. The post aperture may be coincident with an opening of the sleeve.

The post socket may further comprise a spigot positioned adjacent to the actuator aperture on an internal surface of the upper surface. The spigot may include a through-hole, wherein the through-hole is aligned with the actuator aperture.

At least a portion of the upper surface may be removable. The removable portion of the upper surface may include the actuator aperture. In this way, the removable portion of the upper surface may be removed to allow access to the linkage for maintenance.

The actuator may be configured to move the linkage body between an upper position and a lower position and thus move the sleeve from the first position to the second position. In this way, the sleeve may be moved from the first position to the second position, thus retaining a post positioned therein, by actuating a single actuator.

The linkage may include only one arm. Alternatively, the linkage may include two arms, three arms, four arms, or any other number of arms.

The linkage body may be arranged to engage with the spigot when the linkage body is in the upper position. In this way, the spigot may act as an upper limiter and may prohibit further movement of the linkage body from the upper position in a direction away from the lower position. Therefore, the maximum gripping force that the sleeve may apply to the post positioned therein may be limited.

The linkage body may comprise two parallel plates. The two parallel plates may be spaced apart. The first end of the at least one arm may be pivotably attached to a pin connecting the two parallel plates. The pin may be a bolt. The head of the bolt may limit the movement of the bolt in a first direction along an axis of the bolt. The bolt may comprise means to limit the movement of the bolt in a second direction, substantially opposite to the first direction, along an axis of the bolt. The bolt limiting means may be a split pin, a nut, a locking nut, or any other known means.

The actuator may be arranged such that rotation of the actuator moves the linkage body linearly between the upper position and the lower position. A rotatable actuator may provide a large mechanical advantage such that only a small force is required to actuate the actuator, but a large force may be applied to the sleeve by the linkage and thus to the post by the sleeve.

The linkage body may include a threaded socket arranged to receive a rotatable actuator.

The post socket may further comprise a stop member. The stop member may protrude from the housing. The stop member may protrude inwardly from an internal surface of the housing. The stop member may be arranged to limit the movement of the linkage body at the lower position such that further movement away from the upper position may be prohibited. The linkage may place the sleeve in the first position when the linkage body is in the lower position. In this way, the linkage may be placed in the position in which the post may be released from the post socket by moving the linkage body to its lowermost limit. Therefore, releasing the post may be achieved by moving the linkage to a predetermined limit. Furthermore, if the linkage body were allowed to move further away from the upper position past the lower position, the linkage may then start closing the slot and re-gripping the post.

Alternatively, or additionally, a stop member may be arranged to limit the movement of the linkage body at the upper position such that further movement away from the lower position may be prohibited.

The post socket may further comprise a restraining arm. The restraining arm may restrict the movement of the second end of the at least one arm such that the second end of the at least one arm remains a fixed distance from a point on the housing. The restraining arm may include a first end and a second end. The first end of the restraining arm may be pivotably attached to the second end of the at least one arm. The second end of the restraining arm may be pivotably attached to the housing.

The post socket may further comprise limiting means. The limiting means may be arranged to restrict the linkage body to linear movement along an axis parallel to a longitudinal axis of the sleeve.

The limiting means may comprise a linear guide. The linear guide may be positioned on an interior surface of the housing. The linkage body may be arranged to engage with the linear guide. The linear guide may be a slot, a track, a guide, and/or any other known guide means.

The cross-sectional shape of the sleeve may be constant along a length of the sleeve. The cross-sectional area of the sleeve may be constant along a length of the sleeve. In this way, a post with a constant cross-sectional shape and cross-sectional area may be received within the sleeve.

The sleeve may have a cross-sectional shape that is generally circular, oval, rectangular, square, triangular, or any other shape. In this way, the post socket is able to retain a post with a cross-sectional shape that is circular, oval, rectangular, square, triangular, or any other shape. The sleeve may have a cross-sectional shape that is generally complimentary to the post or bollard to be retained within the post socket.

The second internal width of the sleeve may lie in the range of 25 mm to 500 mm. The second internal width of the sleeve may lie in the range of 25 mm to 360 mm. The second internal width of the sleeve may lie in the range of 50 mm to 360 mm. The second internal width of the sleeve may lie in the range of 60 mm to 300 mm. The second internal width of the sleeve may lie in the range of 75 mm to 200 mm. In this way, a commonly sized road side post or bollard may be received within the sleeve. The second internal width of the sleeve may lie in the range of 110 mm to 115 mm. In this way, a post with an external diameter of 115 mm may be releasably securable within the post socket. The second internal width of the sleeve may lie in the range of 355 mm to 360 mm. In this way, a bollard with an external diameter of 360 mm may be releasably securable within the post socket.

A length of the sleeve may be greater than twice the second internal width of the sleeve. In this way, the sleeve may grip the post over a relatively large surface area. This means that the force applied to the post by the sleeve may be spread over a relatively large area, reducing the pressure and any subsequent damage to the post. The length of the sleeve may be at least 2.45 times the second internal width of the sleeve. In one example, a length to internal width ratio of the sleeve in the second position of at least 2.45 has been found to provide improved gripping characteristics.

A surface of the sleeve may be coated with an electrically insulating material. The surface of the sleeve may consist of an electrically insulting material. In this way, galvanic corrosion of the sleeve or a post received therein may be prevented.

The housing may comprise at least three anchor elements. The anchor elements may, in use, engage with material surrounding the housing and increase the force required to move the post socket relative to the ground. Each anchor element may extend from an outer surface of the housing. The anchor elements may include adjustable length legs. The adjustable length legs may be arranged such that, during installation, the length of each leg is adjustable to position the socket as required.

The housing may include only three anchor elements. Alternatively, the housing may include four, five, six, or any number of anchor elements.

The housing may include a telescopic attachment. The telescopic attachment may be extendable along an axis parallel to an axis of the sleeve. The telescopic attachment may be attached to a lower side of the housing.

The housing may include a duct elbow swivel. The duct elbow swivel may be attached to a lower side of the housing or a lower side of the telescopic attachment. The duct elbow swivel may be arranged to rotate through 360° around an axis parallel to an axis of the sleeve. In this way, the housing may be arranged to receive cables from any direction.

The linkage may be positioned between the housing and the sleeve.

The sleeve may comprise a first part joined to a second part by a joint.

The joint may have a different elastic modulus to the first and second parts of the sleeve. The joint may be a weld. In this way, the bending characteristics of the sleeve may be controlled.

The housing may be a box-like structure. The housing may comprise six planar sides including a front side, a back side, a right side, a left side, an upper side, and a lower side. The housing may comprise two pieces arranged to be connected together. The housing may comprise three pieces arranged to be connected together. A first piece of the housing may be generally C-shaped. The first piece of the housing may include the left side, a portion of the front side, a portion of the back side, and a portion of the upper side. The portion of the upper side of the first piece may be the removable portion of the upper surface. A second piece of the housing may be generally C-shaped. The second piece of the housing may include the right side, a portion of the front side, a portion of the back side, and a portion of the upper side. The lower side may be positioned wholly or partially on the first and/or section piece of the housing. Alternatively, the lower side may be a separate piece of the housing. The lower side may be attachable to the first and/or second piece of the housing. The housing pieces may be connected together with fixings. Alternatively and/or additionally, the housing pieces may be welded together.

The linkage may be positioned between the left side of the housing and the sleeve.

The sleeve may be positioned closer to the right side of the housing than to the left side of the housing.

The sleeve may be positioned to rest on the lower side. Alternatively, the sleeve may be positioned to be spaced from the lower side. The linkage may be arranged such that it holds the sleeve in a position wherein the sleeve is suspended above the lower side.

A handle may project from the housing. A handle may project from the front side, the rear side, the left side, the right side, and/or the lower side. In this way, transport and installation may be more easily achieved.

The housing may include a drain. The drain may be an aperture in the housing. The drain may be arranged such that, in use, water entering the housing is able to drain from the housing.

The housing may include a cable aperture. The cable aperture may be an aperture in the housing. The cable aperture may be arranged such that cables can pass from outside the housing to inside the housing. In this way, power and/or signal cables may be provided to a sign positioned on a post received within the post socket. The drain and the cable aperture may be the same aperture.

The actuator may include a security tool engagement portion, such that actuation of the actuator is only possibly if a security tool is engaged with the actuator. The security tool may include a key. The security tool may be a master key. The master key may be arranged to be engageable with the security tool engagement portion of a plurality of post sockets. In this way, emergency services may need only carry the master key to be able to remove a post or bollard from its post socket to gain access if required.

The actuator and/or linkage body may include a clutch arranged to slip if a torque above a predetermined level is applied to the actuator by a tool. In this way, over tightening of the actuator is prohibited.

The post socket may include an adjustable upper cover. The adjustable upper cover may be attachable to the housing. The post socket may comprise means for adjusting the angle between a plane of the adjustable cover and a plane of the upper part of the housing. Such means may be a set of nuts and bolts. In this way, when the post socket is installed in ground with a gradient, the adjustable upper cover may be used to provide an upper surface of the post socket that is flush with the surface of the ground.

The post socket may include a plug arranged to be received within the post socket when no post is positioned therein. The plug may have an upper surface that is flush with an upper surface of the housing. In this way, when a post is removed from the post socket, the plug may be used to cover the hole left in the ground.

The sleeve may comprise two semi-cylindrical halves such that the sleeve has two slots opposite one another, both extending the entirety of the longitudinal axis of the sleeve. The two slots comprise the slot described above and another, second, slot.

An outer housing may be arranged around the housing described above.

Any of the above-mentioned components may be manufactured from manganese self-hardening steel. In this way, the component will be resistant to drilling or cutting.

BRIEF DESCRIPTION OF THE DRAWINGS

The above and other characteristics, features and advantages of aspects of the present invention will become apparent from the following detailed description, taken in conjunction with the accompanying drawings, which illustrate, by way of example, the principles of aspects of the invention. This description is given for the sake of example only, without limiting the scope of the invention. The reference figures quoted below refer to the attached drawings.

DETAILED DESCRIPTION

Figure 1:
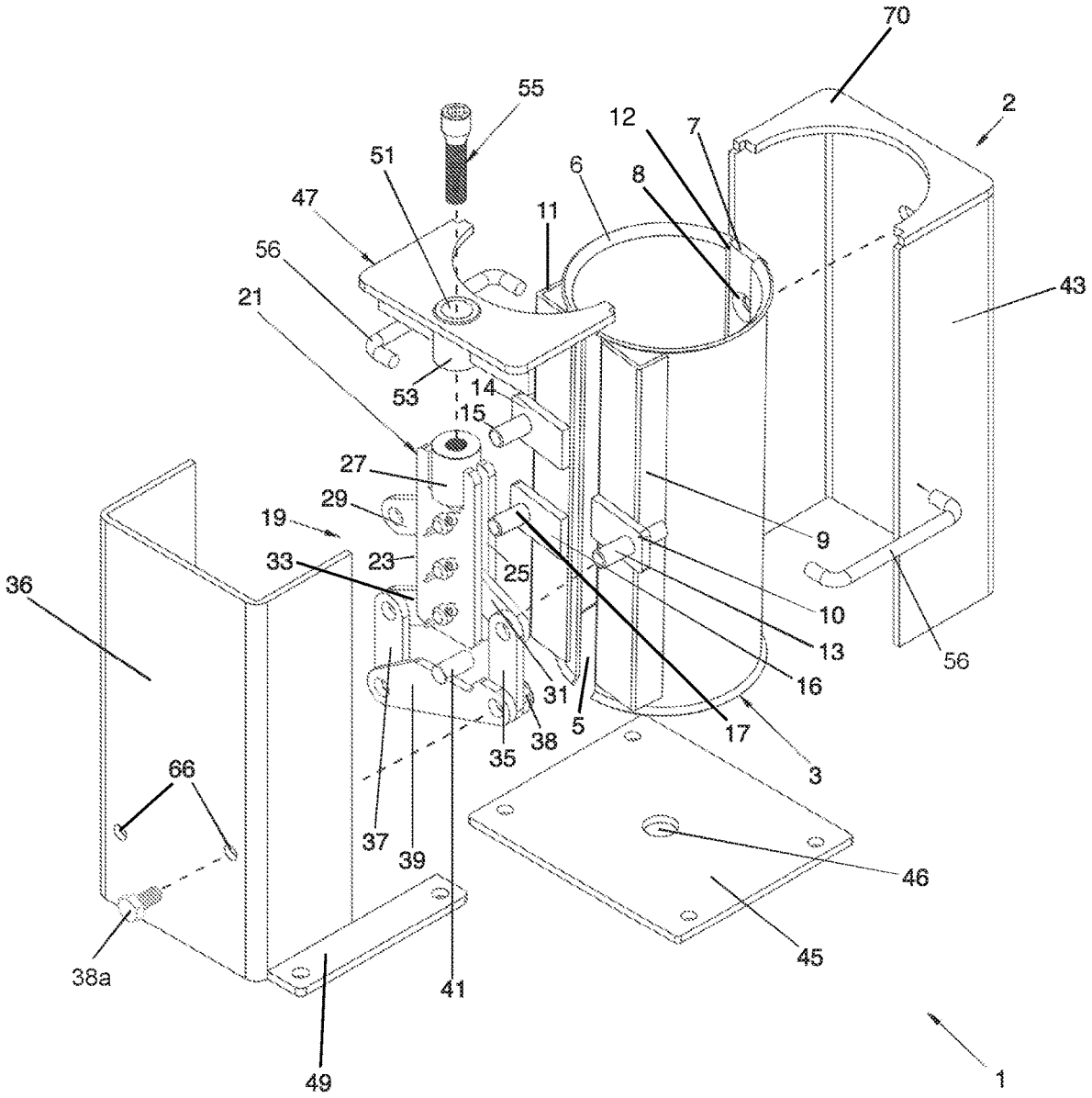
FIG. 1 is an exploded view of a post socket.

Aspects of the present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the features listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to aspects of the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or elements. "Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of aspects of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The principles of aspects of the invention will now be described by a detailed description of at least one drawing relating to exemplary features. It is clear that other arrangements can be configured according to the knowledge of persons skilled in the art without departing from the underlying concept or technical teaching, aspects of the invention being limited only by the terms of the appended claims.

FIG. 1 is an exploded view of a post socket 1. The post socket 1 comprises a substantially cylindrical sleeve 3 oriented, in use, with its longitudinal axis substantially vertical. The sleeve 3 is open at its upper end for accepting a post.

The sleeve 3 includes a slot 5 which runs along its height from top to bottom, parallel to the longitudinal axis that is aligned with the bore of the generally cylindrical sleeve 3. The upper and lower rims of the sleeve 3 each include a lip 6 that extends away from the bore of the sleeve 3. Each lip 6 is positioned such that the angle between the axis of the bore of the sleeve 3 and an axis that is parallel to a surface of the lip 6 and intersects the axis of the bore of the sleeve 3 is approximately 45 degrees. The sleeve 3 is arranged within a housing 2 which is substantially cuboid in shape and comprises two halves 36, 43; the split being in a substantially vertical plane. The housing 2 further includes a substantially rectangular base plate 45 on which the two halves 36, 43 rest. Each half 36, 43 includes a plate 49 projecting outwardly from its lower end for attaching it to the base plate 45 via bolts passing through corresponding through-holes arranged in the projecting plates 49 and base plate 45.

The sleeve 3 includes a housing attachment bracket 7 positioned on its outer surface opposite the slot 5. The bracket 7 provides a planar surface for locating the cylindrical outer surface of the sleeve 3 against the inner planar surface of one of the halves 43 to prevent rotation of the sleeve 3 about its longitudinal axis. The sleeve 3 and the housing attachment bracket 7 include corresponding through-holes 8 which allow the sleeve to be attached to the housing 2 with a bolt.

The sleeve 3 is compressible around its longitudinal axis so as to at least partially close the slot 5 so as to grip a post when one is placed inside the sleeve, in use.

The sleeve 3 may include a first part joined to a second part by a joint 12. Although FIG. 1 exemplarily illustrates the joint 12 running vertically up the sleeve 3, exemplary embodiments are not limited thereto, and the joint 12 may be oriented differently from that shown in FIG. 1.

To enable the sleeve 3 to be compressed the device includes two linkage attachment brackets 9 and 11, one each positioned adjacent either side of the slot 5. Each linkage attachment bracket 9 and 11 is L-shaped and is attached to the sleeve 3 such that the two free ends of the L-shaped brackets 9 and 11 are in contact with the sleeve 3, and the corner of the brackets 9 and 11 are spaced from the sleeve 3. The first linkage attachment bracket 9 is positioned on a first side of the slot 5 and has an edge that is adjacent to, and runs parallel to, a first edge of the slot 5. The second linkage attachment bracket 11 is positioned on a second side of the slot 5 and has an edge that is adjacent to, and runs parallel to, the second edge of the slot 5. In this way planar surfaces adjacent the slot 5 are created which lie in the same plane. The attachment brackets 9 and 11 may also serve to reinforce the sleeve 3 in the region proximal to the slot 5.

A first rectangular planar member 10 is attached to the planar surface of the first linkage attachment bracket 9 at a point approximately midway between the top and bottom of the sleeve 3. This rectangular planar member 10 is wider than the planar surface to which it is attached and includes a pin 13 projecting outwardly from a surface thereof away from the sleeve 3, in an axis that is normal to the planar surface of the attachment bracket 9.

Second 14 and third 16 rectangular planar members are attached to the second linkage attachment bracket 11 on the other side of the slot 5. These second 14 and third 16 rectangular planar members are located at a third and two-thirds along the height of the sleeve with the second being uppermost. Each of the second and third rectangular planar members 14, 16 include a pin 15, 17 projecting outwardly from a surface thereof and away from the sleeve 3 in an axis that is normal to the planar surface of the attachment bracket 11 in a similar manner to the pin 13 on the first rectangular planar member 10.

A linkage 19 is provided adjacent to the slot 5. The linkage 19 comprises a linkage body 21 that is formed of two substantially rectangular parallel plates 23, 25 which are slightly spaced apart. The two parallel plates 23, 25 each lie in a plane that is parallel to the planar surfaces of the first and second 9, 11 linkage attachment brackets. The linkage body also includes a threaded socket 27, in the form of a cylindrical member, positioned at its upper end. The socket 27 includes a threaded bore open at its upper end with its bore being vertical in use, i.e. lying along an axis which is parallel to the longitudinal axis/bore of the sleeve 3.

The linkage 19 further comprises three substantially straight arms 29, 31, 33. The three arms 29, 31, 33 are generally obround in shape and each include two through-holes, one at each end. They are dimensioned such that one end of each arm is able to fit into the gap between the two plates 23, 25. Each of the three arms 29, 31, 33 are pivotably attached at a first end to the linkage body 21 via clevis pins passing through each of the two parallel plates 23, 25 and one of the through-holes. The clevis pins are secured with split pins. Two arms are located on one side of the linkage and one on the opposite side, each aligned with and pivotably connected to one of each of the pins 13, 15, 17 described above via the through-holes arranged at the other end of each arm. Split pins may be used to retain the pins and arms together. The arms 29, 31, 33 extend approximately horizontally and outwardly from the linkage body 21.

The linkage 19 further comprises two similarly shaped obround restraining arms 35, 37 each including a through-hole at each end thereof. One restraining arm 35 is also pivotably connected to the pin 13 projecting from the first planar rectangular member 10, and one restraining arm 37 is also pivotably connected to the pin 17 projecting from the third planar rectangular member 16. The restraining arms 35, 37 are arranged such that their longer lengths are approximately vertical.

The opposite end of each restraining arm 35, 37 is pivotably attached to the housing 36 via holes 66 provided therein and bolts 38*a* (only one shown). The bolts 38*a* are secured with a nut 38. In this way, the lower end of each restraining arm 35, 37 is fixed relative to the housing 36 in use.

The linkage 19 also includes a planar stop plate 39 which includes two through-holes, one at each end thereof. The plate 39 is arranged such that each of the two through-holes are coaxial with the through-holes at the lower end of the restraining arms 35, 37 and received on the bolts 38*a* therein, such that the stop plate 39 is fixed to the housing 36.

A stop pin 41 (also referred to as a "stop member"), in the form of a cylinder lying with its longitudinal axis substantially horizontal in use, is positioned on the stop plate 39 such that it projects towards the sleeve 3. Its function is explained below.

The housing 2 also includes two halves 47, 70 which collectively form an upper plate (hereinafter, also referred to as an "upper surface") which matches the size of the housing 2 so as to close it. The upper plate includes a hole cut out of it (also referred to as a "post aperture") approximately the same diameter as the sleeve 3 before the sleeve 3 is compressed by the linkage so that in use it may accept a post therethrough. The upper plate is split into two approximately equal halves 47, 70, each half including half of the circular cut-out portion. One half 70 is fixed to one half 43 of the housing 2. The other half 47 is removable.

The upper part 47 also includes an actuator aperture 51 in its surface. A cylindrical spigot 53 is positioned on a lower surface of the upper part 47 and includes a through-hole that is coaxial with the actuator aperture 51. The through-hole of the spigot 53 and the actuator aperture 51 each extend along an axis parallel to the longitudinal axis of the sleeve 3. A rotatable actuator 55 in the form of a bolt is arranged passing through the actuator aperture 51 and the through-hole of the spigot 53 and received by the threaded socket 27 of the linkage 19. The actuator's threads engage with the threads of the socket 27 such that the actuator 55 may be wound into and out of the socket 27. The actuator 55 may be completely removable from the device 1.

The housing 2 also includes two handles 56 positioned on opposite sides thereof. The handles 56 allow for easier handling by a user, and may also act as anchor elements for increasing the force required to remove the post socket 1 after the post socket 1 has been buried in the ground.

A drain hole 46 is provided in the base plate 45.

Figure 2:
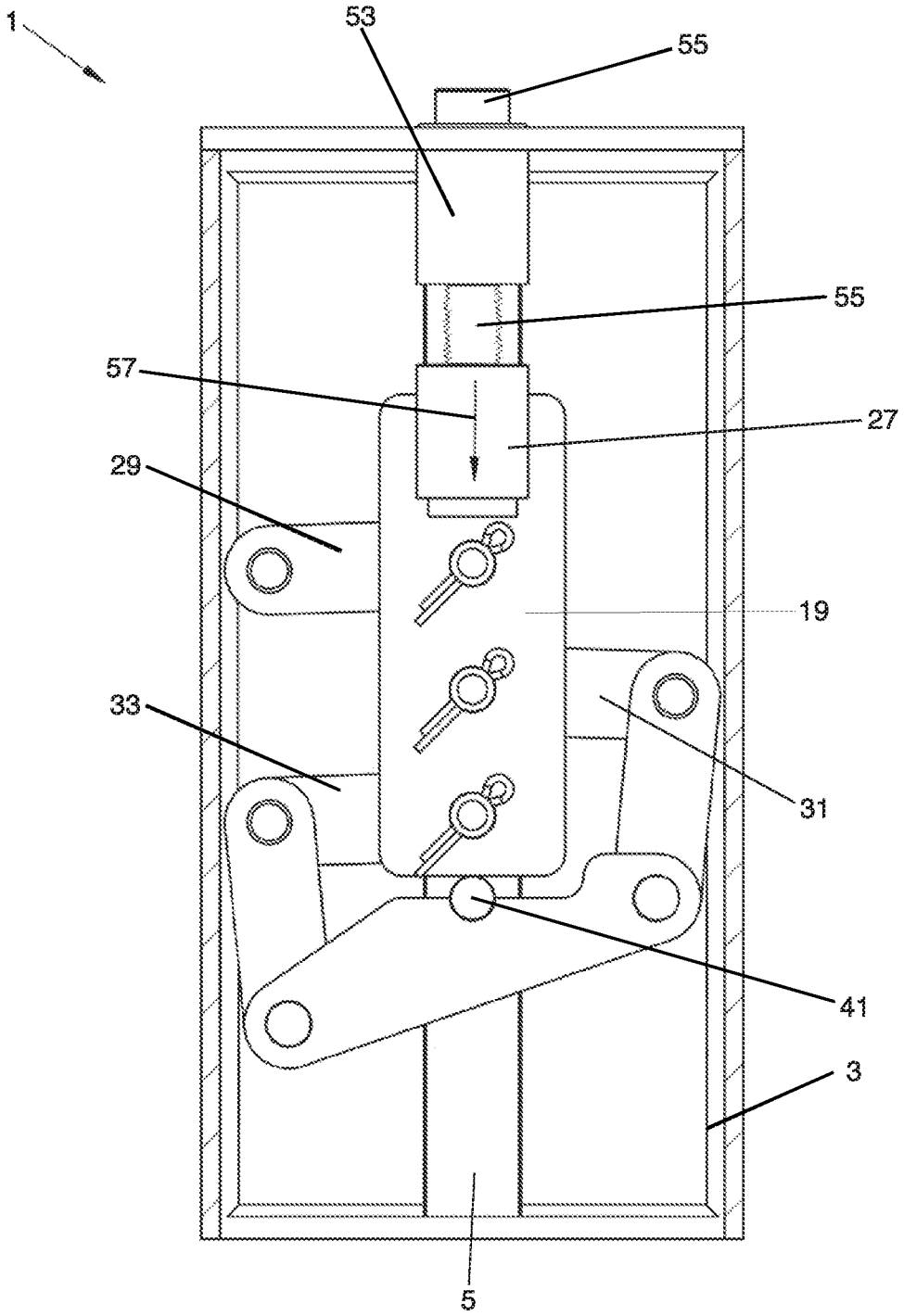
FIG. 2 is a schematic view of the post socket with the sleeve in the first position.

FIG. 2 is a schematic view of the post socket 1 with the sleeve 3 in an uncompressed position. In this position, the rotatable actuator 55 has been unscrewed such that the rotatable actuator 55 is only in contact with the threaded socket 27 at the very top of the socket, or the rotatable actuator 55 may have been completely unscrewed/unwound and removed.

In this position, the linkage body 21 is in its lowermost position, as indicated by arrow 57, and is prohibited from moving further downwards by the stop pin 41 abutting the underside of the linkage body 21 thus preventing the linkage body 21 from moving downwards relative to the housing 2.

The threaded socket 27, at the upper end of the linkage body 21, is seen to be spaced from the spigot 53. The three arms 29, 31, 33 are consequently positioned horizontally, and the slot 5 is opened to its maximum. In this first position, the internal width of the sleeve 3 is larger than the external diameter of a post to be received therein, which means that the post may be removed from, or inserted into, the post socket.

Figure 3:
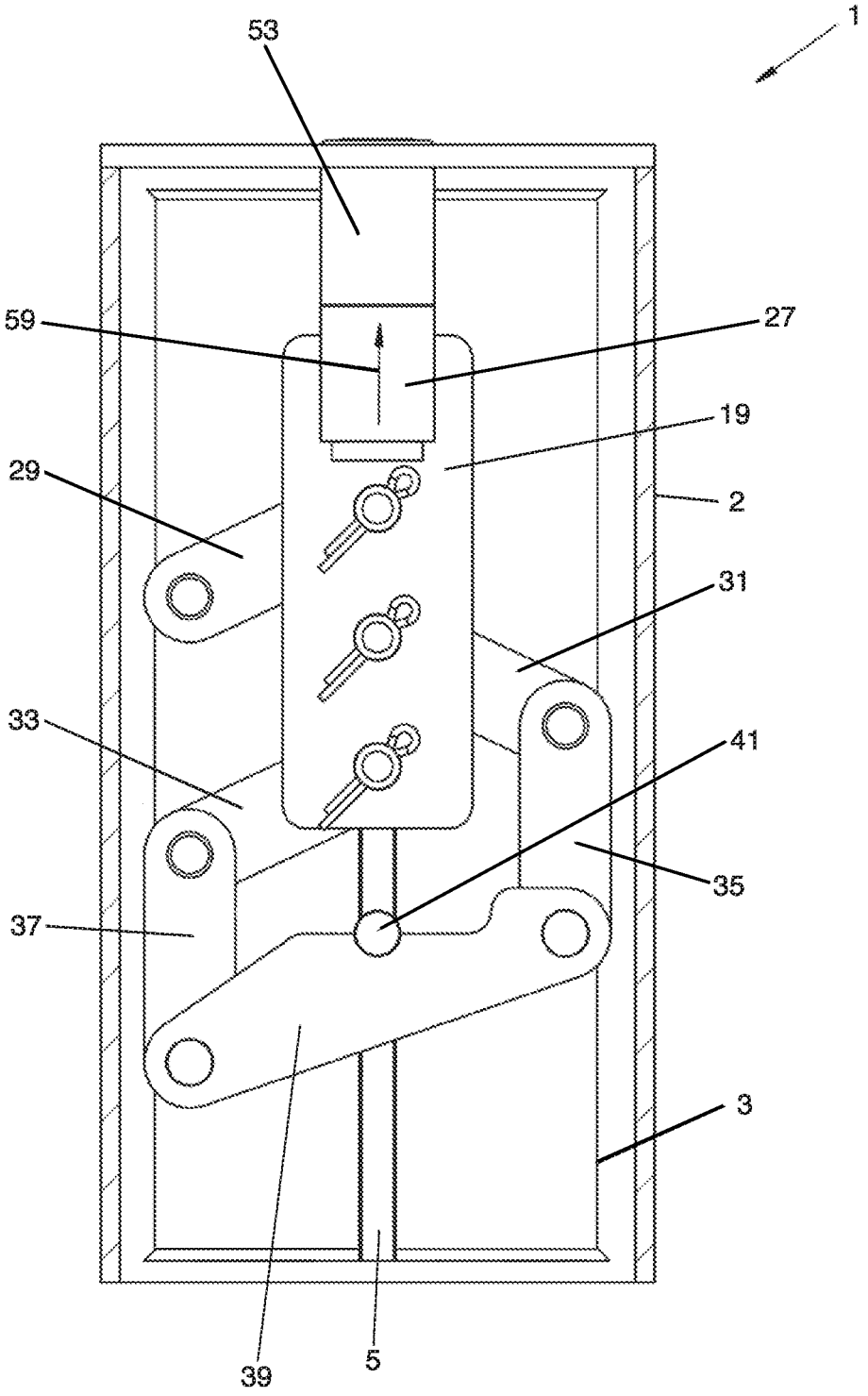
FIG. 3 is a schematic view of the post socket with the sleeve in the second position.

FIG. 3 is a schematic view of the post socket 1 with the sleeve 3 in a second position. To achieve this position, the rotatable actuator 55 has been screwed downwardly into the threaded socket 27. By this action, the threaded socket 27 at the upper end of, and with, the linkage body 21 has been pulled upwardly as indicated by arrow 59.

However, the linkage body 21 is prohibited from moving further upwards as the upper end of the threaded socket 27 is abutting the lower end of the spigot 53. A gap is visible between the underside of the linkage body 21 and the stop pin 41. The stop plate 39 remains stationary relative to the housing 2. The two lowermost arms 31, 33 are connected at their outer ends thereof to the restraining arms 35, 37, which are in turn connected to the stationary stop plate 39. However, the upper ends of the restraining arms 35, 37 have moved upwardly with the linkage body 21. Accordingly, the restraining arms 35, 37 now lie inclined to the horizontal. This movement is transferred to the sides of the slot 5, to which the upper ends of the arms 31, 33 are connected, such that the width of the slot 5 has been reduced and the sleeve 3 has become compressed.

The third arm 29 will likewise apply a compressional force on the slot due to its arrangement. With the sleeve 3 in this second position a post positioned therein will be gripped and thus retained within the post socket 1. The device 1 allows for a substantially even compressional force to be applied along the length of the post within the sleeve which thus prevents damaging the post or the application of point loading.

Figure 4:
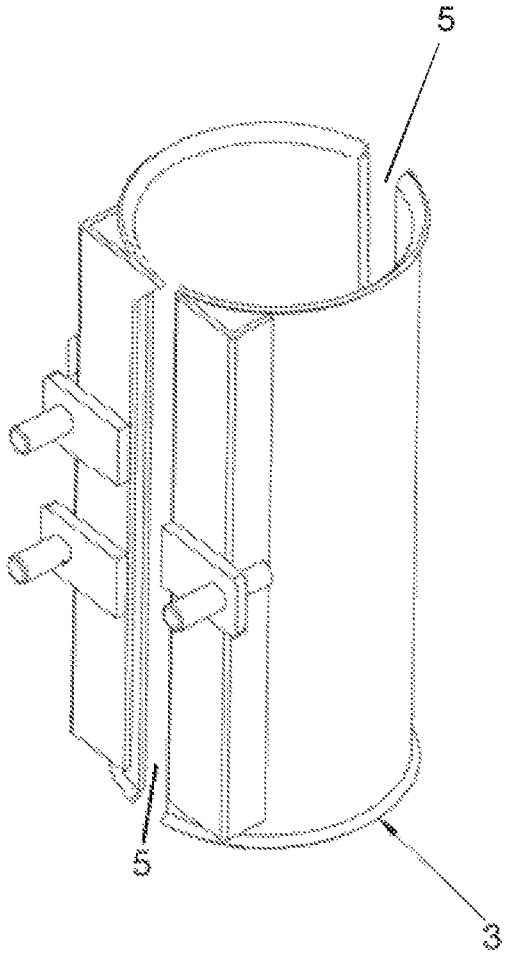
FIG. 4 is a perspective view of an alternative sleeve for use with a post socket.

FIG. 4 is a perspective view of an alternative sleeve 3 for use with the post socket 1 shown in the previous figures. The sleeve 3 is substantially cylindrical, and is oriented, in use, with its longitudinal axis substantially vertical. The sleeve 3 is open at its upper end for accepting a post. The sleeve 3 includes two slots 5 opposite one another which run along the height of the sleeve 3 from top to bottom, parallel to the longitudinal axis that is aligned with the bore of the generally cylindrical sleeve 3.

What is claimed is:

1. A post socket comprising:

a housing;

a compressible sleeve within the housing, the compressible sleeve configured to receive at least a portion of a post therein, wherein the compressible sleeve is moveable between a first position in which the compressible sleeve has a first internal width and a second position in which the compressible sleeve has a second internal width which is less than the first internal width;

a linkage pivotably connected to the compressible sleeve; and an actuator configured to actuate the linkage to move the compressible sleeve from the first position to the second position to grip and thus retain at least the portion of the post therein, wherein the linkage comprises:

a linkage body connected to the actuator, and at least one arm comprising a first end and a second end, wherein the first end of the at least one arm is pivotably attached to the linkage body and the second end of the at least one arm is pivotably attached to the compressible sleeve, the actuator configured so that actuation of the actuator moves the linkage body to thereby move the first end and the second end of the at least one arm and thus move the compressible sleeve from the first position to the second position;

wherein the compressible sleeve comprises a slot which extends at least partially along the compressible sleeve and is configured to at least partially close when the compressible sleeve is moved from the first position to the second position by the linkage; and wherein the compressible sleeve further comprises a first bracket positioned adjacent to a first side of the slot and a second bracket positioned adjacent to a second side of the slot, wherein the first bracket comprises a first linkage attachment point and the second bracket comprises a second linkage attachment point, wherein the first linkage attachment point and the second linkage attachment point are connected to the linkage.

2. The post socket of claim 1, wherein the slot extends at least partially along the compressible sleeve parallel to a longitudinal axis of the compressible sleeve.

3. The post socket of claim 1, wherein the first linkage attachment point comprises a first pin projecting therefrom, and the second linkage attachment point comprises a second pin projecting therefrom.

4. The post socket of claim 1, further comprising a housing engagement bracket positioned on an outer surface of the compressible sleeve, wherein the housing engagement bracket comprises a housing engagement surface configured to engage with an internal surface of the housing.

5. The post socket of claim 1, wherein the housing comprises an upper surface comprising an actuator aperture configured to receive a tool for rotation of the actuator therethrough in use, and a post aperture configured to receive at least a portion of a post therethrough.

6. The post socket of claim 5, further comprising a spigot positioned adjacent to the actuator aperture on an internal surface of the upper surface, the spigot including a through-hole, wherein the through-hole is aligned with the actuator aperture.

7. The post socket of claim 6, wherein at least a portion of the upper surface is removable and the removable portion of the upper surface comprises the actuator aperture.

8. The post socket of claim 1, wherein the actuator is configured such that rotation of the actuator moves the linkage body linearly to thereby move the compressible sleeve between the first position and the second position.

9. The post socket of claim 1, further comprising a stop member protruding from the housing arranged to limit the movement of the linkage body such that further movement of the linkage body is restricted and the compressible sleeve cannot move beyond the first position.

10. The post socket of claim 1, further comprising at least one restraining arm configured to restrict the movement of the second end of the at least one arm such that the second end of the at least one arm remains a fixed distance from a point on the housing, the restraining arm including a first end and a second end, wherein the first end of the at least one restraining arm is pivotably attached to the second end of the at least one arm and the second end of the at least one restraining arm is pivotably attached to the housing.

11. The post socket of claim 1, wherein the linkage is positioned between the housing and the compressible sleeve.

12. The post socket of claim 1, wherein the compressible sleeve comprises a first part joined to a second part by a joint.

13. The post socket of claim 1, wherein the compressible sleeve comprises two semi-cylindrical halves such that the compressible sleeve has two slots opposite one another, both extending the entirety of a longitudinal axis of the compressible sleeve.

14. A post socket comprising:

a housing;

a compressible sleeve within the housing, the compressible sleeve configured to receive at least a portion of a post therein, wherein the compressible sleeve is moveable between a first position in which the compressible sleeve has a first internal width and a second position in which the compressible sleeve has a second internal width which is less than the first internal width;

a linkage pivotably connected to the compressible sleeve; and an actuator configured to actuate the linkage to move the compressible sleeve from the first position to the second position to grip and thus retain at least a portion of a post therein;

wherein the compressible sleeve comprises a slot which extends at least partially along the compressible sleeve parallel to a longitudinal axis of the compressible sleeve and is configured to at least partially close when the compressible sleeve is moved from the first position to the second position by the linkage, wherein the actuator is configured such that rotation of the actuator moves the linkage body linearly to thereby move the compressible sleeve between the first position and the second position; and wherein the compressible sleeve further comprises a first bracket positioned adjacent to a first side of the slot and a second bracket positioned adjacent to a second side of the slot, wherein the first bracket comprises a first linkage attachment point and the second bracket comprises a second linkage attachment point, wherein the first linkage attachment point and the second linkage attachment point are connected to the linkage.

* * * * *